US006488554B2

(12) United States Patent
Walker

(10) Patent No.: US 6,488,554 B2
(45) Date of Patent: Dec. 3, 2002

(54) MOORING DEVICE

(76) Inventor: Raymond G. Walker, 32 Howland La., Hingham, MA (US) 02043

( * ) Notice: Subject to any disclaimer, the term of this patent is extended or adjusted under 35 U.S.C. 154(b) by 0 days.

(21) Appl. No.: 09/791,061

(22) Filed: Feb. 23, 2001

(65) Prior Publication Data

US 2002/0117099 A1 Aug. 29, 2002

(51) Int. Cl.[7] ..... B63B 21/00; B63B 22/02
(52) U.S. Cl. ..... 441/3; 114/230.2; 441/23
(58) Field of Search ..... 441/1, 3, 21, 23; 114/230.2, 230.25

(56) References Cited

U.S. PATENT DOCUMENTS 3,077,614 A * 2/1963 Lloyd ..... 114/230.2
4,462,329 A * 7/1984 Brushaber ..... 114/219
4,529,388 A * 7/1985 Jones et al. ..... 114/230.11
5,520,134 A * 5/1996 Walker ..... 114/230.25

* cited by examiner

*Primary Examiner*—Sherman Basinger
(74) *Attorney, Agent, or Firm*—John P. McGonagle

(57) ABSTRACT

A vertical, flexible, fiberglass pole extending vertically upward from a mooring buoy, the pole having a resilient line holder attached near to the top of the pole. Reflective tape is applied to the pole. The line holder retains a mooring line, which is secured at one end to a chain anchoring the mooring buoy. In an alternate embodiment, a resilient line holder is attached to a piling through a vinyl base. The hook is arranged vertically, but can rotate in a horizontal plane 180 degrees. A label of reflective tape is applied to the vinyl base for increased visibility, even during nighttime. The line holder retains a mooring line, which is secured at one end to a cleat attached to the piling, in a coil until removed when mooring.

4 Claims, 6 Drawing Sheets

MOORING DEVICE

BACKGROUND OF THE INVENTION

This invention is related to mooring devices, and more particularly to an apparatus which aids in the mooring of a boat at a mooring buoy or piling.

The usual mooring buoy or float has a ring to which a mooring cable or rope is attached. With this arrangement it is difficult to "pick up" the buoy or to attach a mooring rope to the buoy due to the tossing of the boat and the buoy. Another factor will be the boat's momentum at the time. It is difficult to judge distance so accurately that power or sails can be reduced sufficiently at such a time that the forward movement of the boat will be dissipated at the time it is alongside the buoy, especially in a wind. It is dangerous to pick up the buoy when the boat is moving even slowly as a heavy boat has much momentum and cannot be stopped by holding onto the buoy by the hand. Furthermore, in choppy water, it is difficult to hold the boat for a sufficient period of time to connect the mooring rope with the ring or other attachment devices of the buoy. It is also common for the operator of a boat to "lose" the mooring under the bow of the boat when he approaches within ten to fifteen feet.

In an area where finger piers are short in length and the rise and fall of the tide is less than four feet, a different system for mooring boats is used than the system used with a large rise and fall of the tide. In the former system, two pilings (Dolphins) are driven in eight or ten feet beyond the outer end of the boat. When landing, the crew must pick up both lines when passing by to keep the boat from striking the walkway. With a cross wind blowing, the boat blows to one side, usually coming in contact with a piling. It may be easy enough to lift a line off a hook attached to one pile, but very difficult to do the same when the other piling is six to eight feet beyond the reach of the helper. The standard prior art piling hook holding the coil of line is made of wood, steel or rigid plastic. Because of its configuration, the line cannot be pulled horizontally off the rigid hook or it will become snarled. Currently, the only way the line can be taken off the piling hook is to lift it vertically by hand.

Several prior art devices have attempted to address the problems of mooring a boat to a buoy by extending a pole above the buoy with a hooking means for receiving and snaring a line from the boat. See, e.g., U.S. Pat. Nos. 1,921,500 and 1,801,729. However, the previously described mooring problems are not addressed by these patents.

Applicant has previously addressed some of the above problems encountered when mooring a boat at a boat dock. See, Applicant's U.S. Pat. No. 5,520,134, "Docking Aid Apparatus", Issued on May 28, 1996 ('134 Patent), and incorporated herein by reference. However, to the best of Applicant's knowledge, the principles of the '134 Patent have not been applied to mooring buoys or to pilings.

SUMMARY OF THE INVENTION

In view of the foregoing disadvantages inherent in the known types of devices now present in the prior art, the present invention provides a mooring aid. As such, the general purpose of the present invention, which will be described subsequently in greater detail, is to provide a new and improved mooring aid which is simple and flexible in its use.

To attain this, the present invention, in one embodiment, provides a vertical, flexible, fiberglass pole extending vertically upward from a mooring buoy. The pole has a resilient line holder attached near to the top of the pole. Reflective tape is applied to the pole for increased visibility, even during night time. The line holder retains a mooring line, which is secured beneath the buoy, in a coil until removed when mooring. A deckhand reaches out from an approaching boat to grasp any part of the mooring line and, regardless, if there is still line left on the line holder, a horizontal pull will release the entire coil, down to where the other end of the mooring line is secured beneath the buoy. The free end of the mooring line is secured to the boat deck at a predetermined length that will automatically bring the boat to a halt and stop its forward momentum. The resiliency of the line holder prevents entanglement of the mooring line. A person single-handling a boat can reach out safely retrieving the mooring line and easily bringing the line back to the helmsman station, thereby eliminating the danger of running forward when he thinks the boat is on the mooring buoy.

In another embodiment of the invention a resilient line holder is attached to a piling by means of a vinyl base. The hook is arranged vertically, but can rotate in a horizontal plane 180 degrees. A label of reflective tape is applied to the vinyl base for increased visibility, even during nighttime. The line holder retains a mooring line, which is secured at one end to a cleat attached to the piling, in a coil until removed when mooring. A deckhand reaches out from an approaching boat to grasp any part of the mooring line and, regardless, if there is still line left on the line holder, a horizontal pull will release the entire coil, down to where the other end of the mooring line is secured to the piling cleat. The free end of the mooring line is secured to the boat deck at a predetermined length that will automatically bring the boat to a halt and stop its forward momentum. The resiliency of the line holder prevents entanglement of the mooring line. A person single-handling a boat can reach out safely retrieving the mooring line and easily bringing the line back to the helmsman station.

These together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
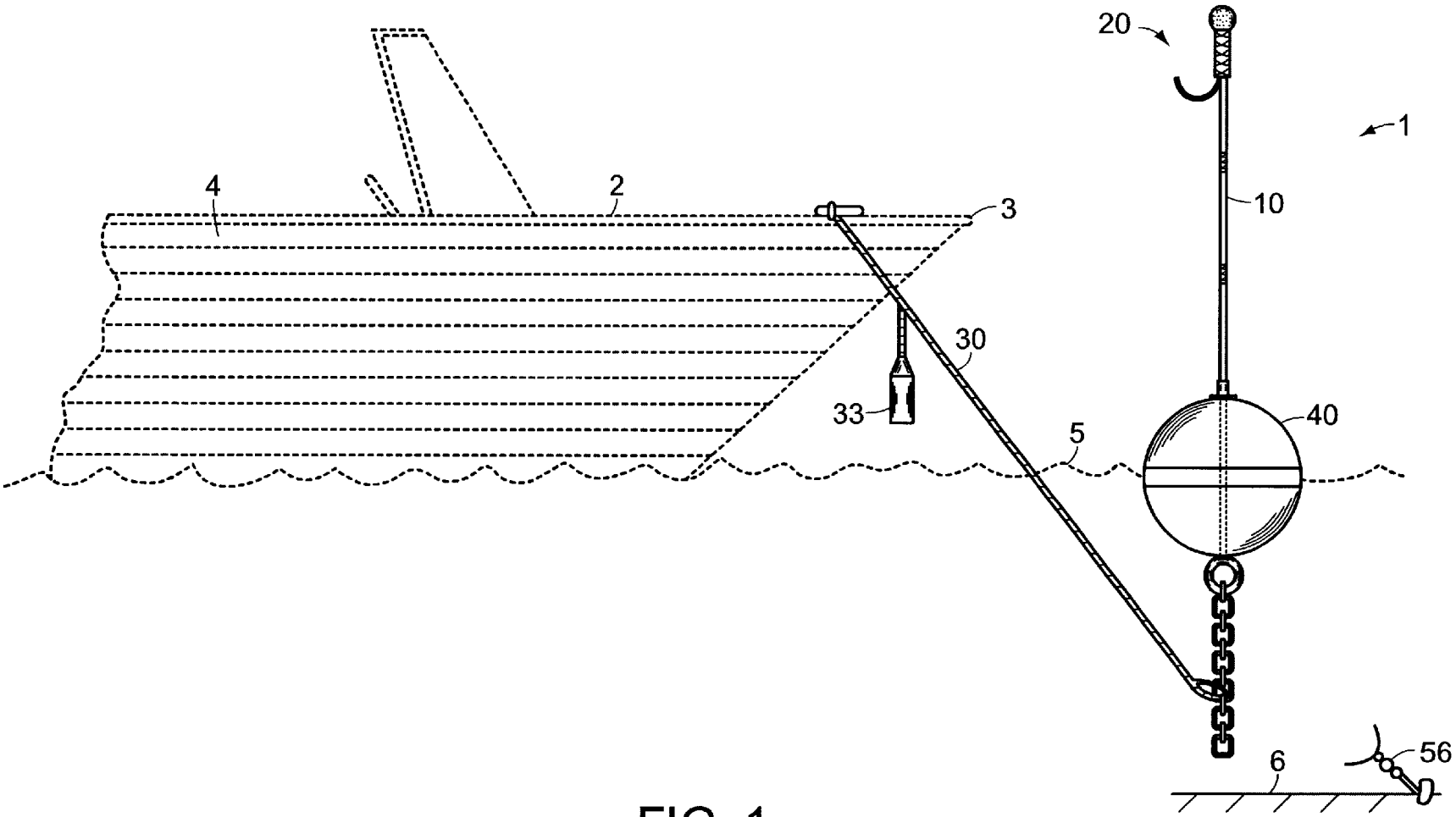
FIG. 1 is a perspective view of one embodiment of an arrangement constituting the invention for mooring a boat.
Figure 2:
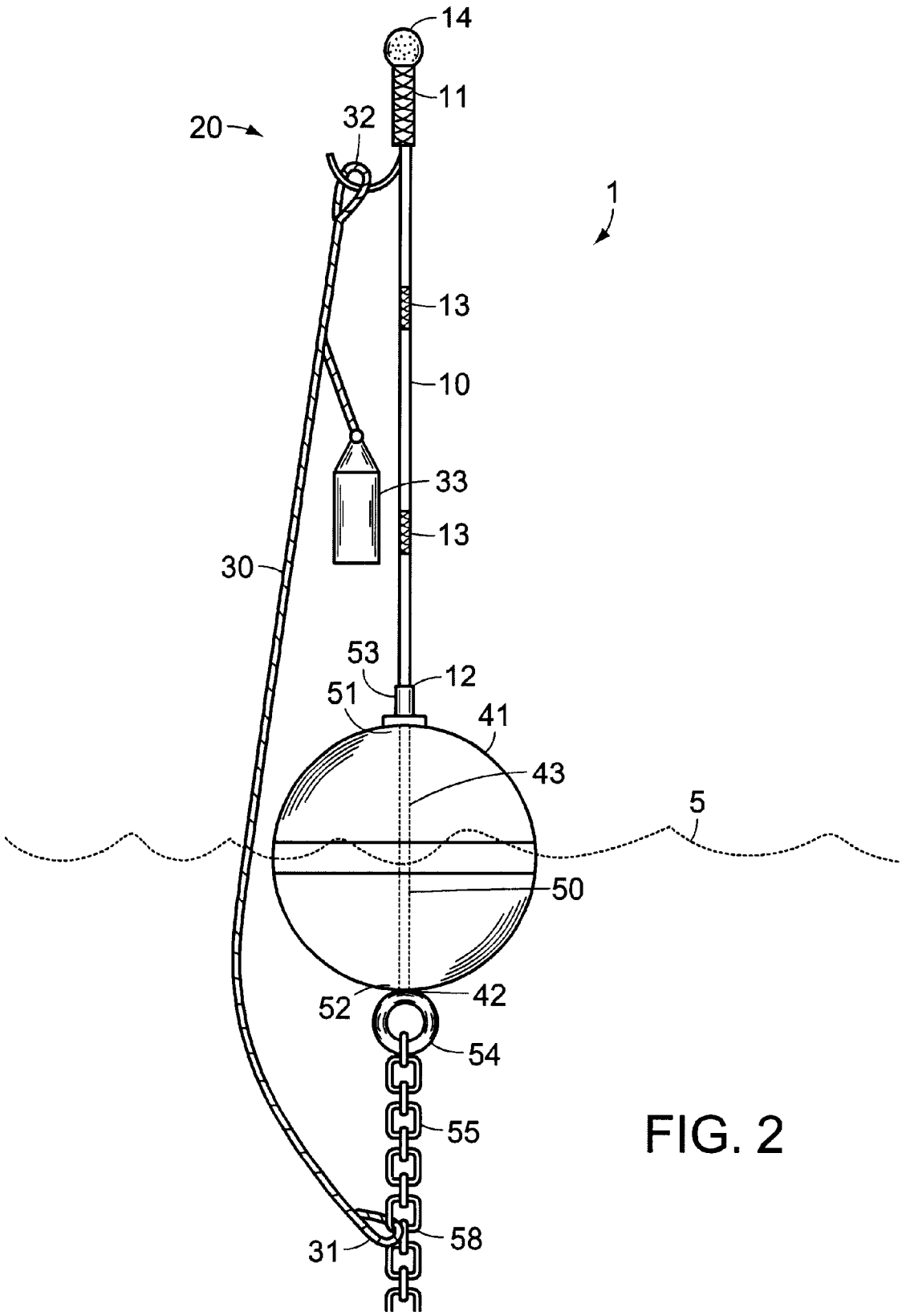
FIG. 2 is a side view of the invention embodiment shown in FIG. 1.

Referring to the drawings in detail wherein like elements are indicated by like reference numerals, there is shown inventions embodiments incorporating devices to assist in mooring a boat 2. In one embodiment, the invention 1 is comprised of a vertical, straight, five foot length, fiberglass pole 10 with a line holder 20 attached thereto, said pole being attached to a mooring buoy 40. The length of the pole 10 may be extended or shortened, depending upon the need. Fiberglass is used as the material of choice because it is flexible, and, if struck while mooring, will bend without breaking. Fiberglass is also nearly impervious to weather conditions. Other materials having these same characteristics may be substituted for fiberglass. The pole 10 has a top end 11 and a bottom end 12. The pole bottom end 12 is fixedly attached to the mooring buoy 40. The line holder 20 is attached to the pole 10 approximately ten inches below the pole top end 11.

The mooring buoy 40 is generally round, buoyant, and may have a ball-shape with a diameter of approximately fifteen inches or more depending on the weight of the mooring chain 55. It may be hollow or made out of a rigid, lightweight plastic material such as polystyrene sold under the Styrofoam trademark. When placed into water 5, the buoy 40 will have a buoyancy which generally adapts it to being half in and half out of the water 5. The buoy 40 has a top 41 defined as that point vertically highest out of calm water, and has a bottom 42 defined as that point vertically deepest in calm water 5. The buoy 40 has a vertical central axis defined by the buoy top 41 and bottom 42. The mooring buoy 40 has a ⅝ inch diameter hole 43 drilled along its vertical central axis.

The mooring buoy vertical central axis 43 has a threaded galvanized rod 50 inserted therein. The rod 50 has a top end 51 and a bottom end 52, both ends reaching the mooring buoy top 41 and bottom 42, respectively. The rod top end 51 has a hollow cylindrical collar element 53 fixedly attached thereto. The collar element 53 is adapted to receiving the bottom end 12 of the fiberglass pole 10. The rod bottom end 52 terminates in a threaded galvanized ⅝ inch ring 54. A heavy mooring chain 55 is attached to the ring 54. The weight of the chain 55 serves as a counterbalance to the fiberglass pole 10. The unattached end 56 of the chain 55 is anchored to the bottom 6 beneath the water 5.

Figure 3:
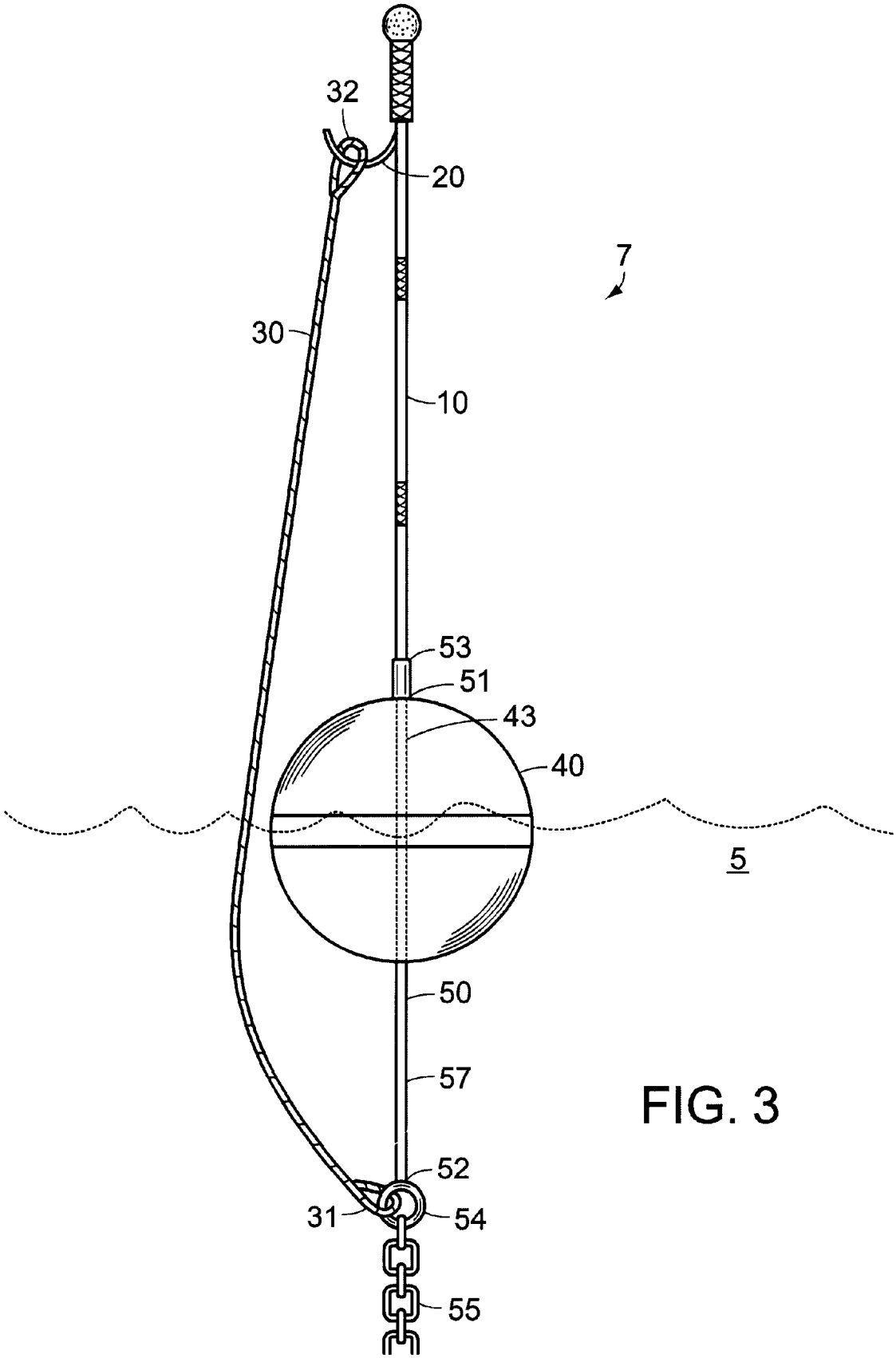
FIG. 3 is a side view of another embodiment of the invention.
Figure 4:
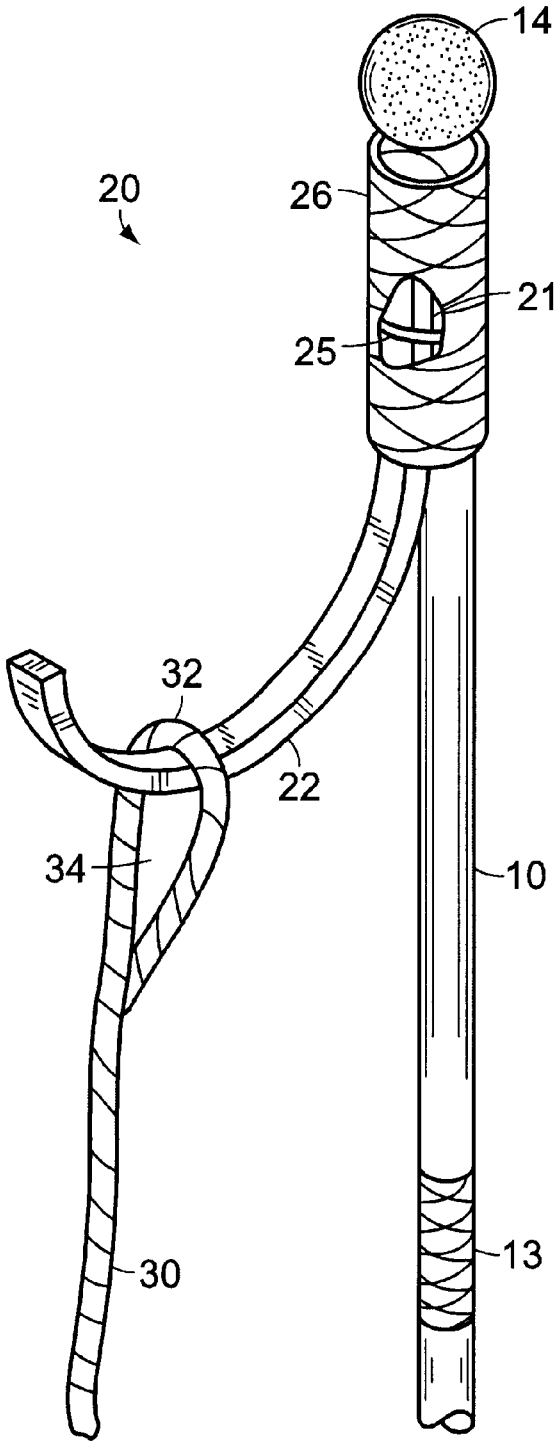
FIG. 4 is a close up view of the line holder portion of the invention embodiments shown in FIGS. 2 and 3.
Figure 6:
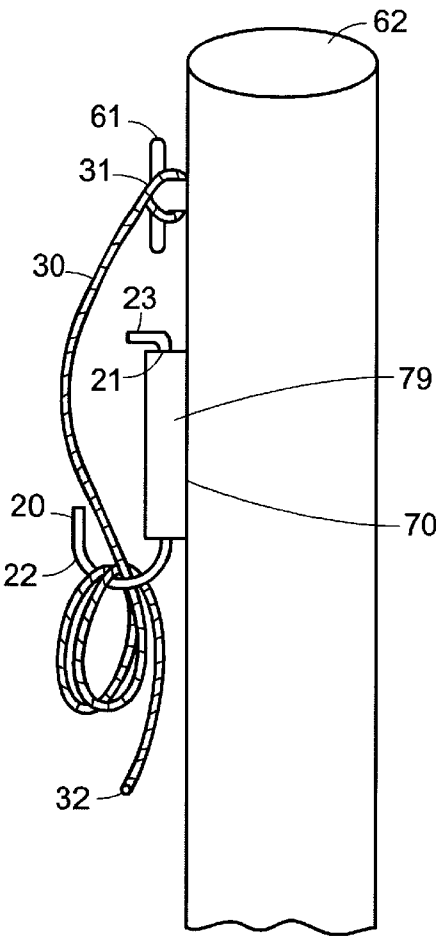
FIG. 6 is a side view of the embodiment shown in FIG. 5.
Figure 5:
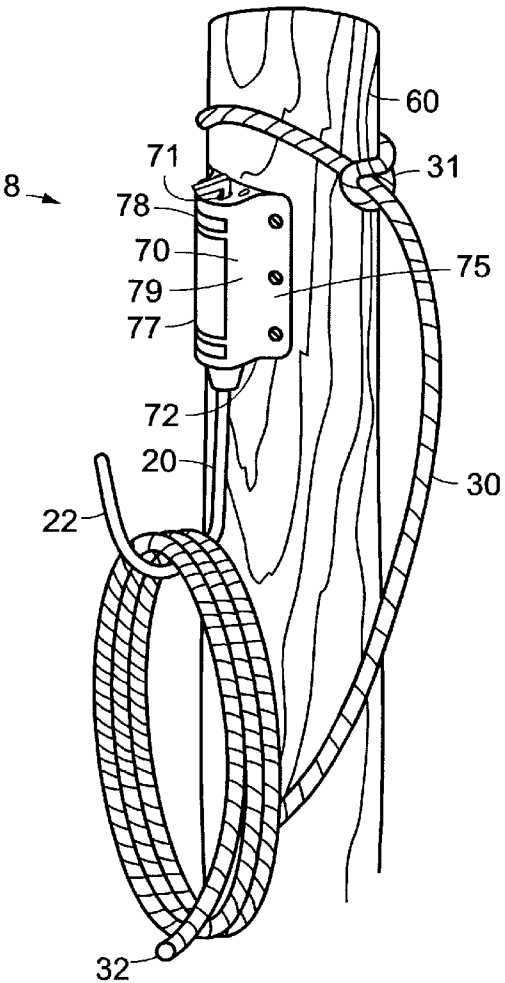
FIG. 5 is a perspective view of a third embodiment of the invention installed on a piling adjacent to a finger pier.
Figure 9:
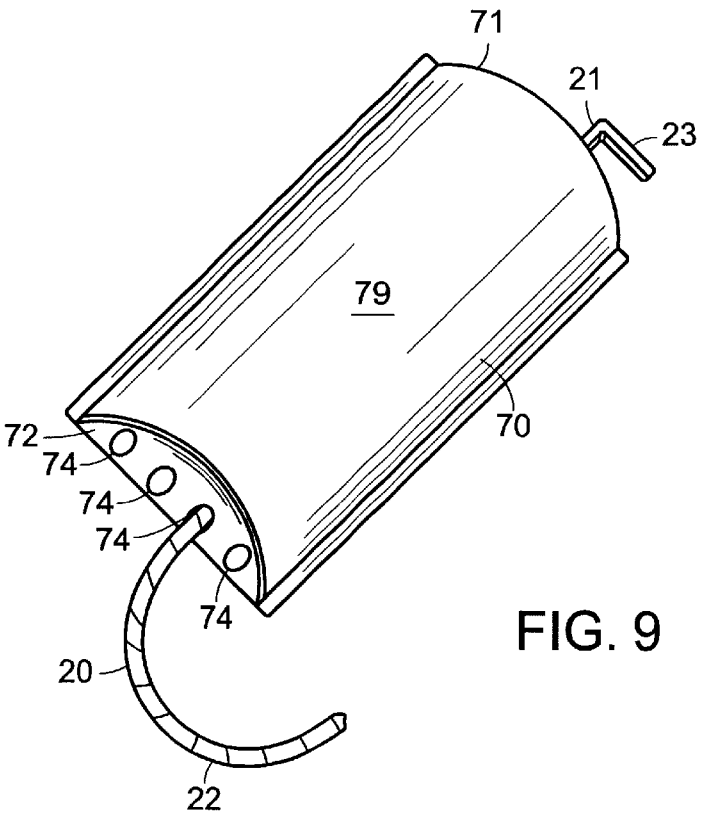
FIG. 9 is a front perspective view of the base unit and line holder.
Figure 7:
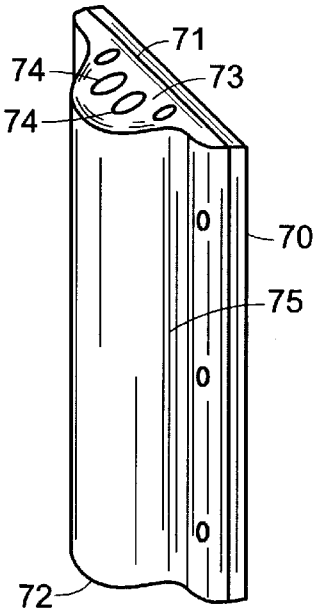
FIG. 7 is a perspective view of the base shown in FIG. 5.
Figure 8:
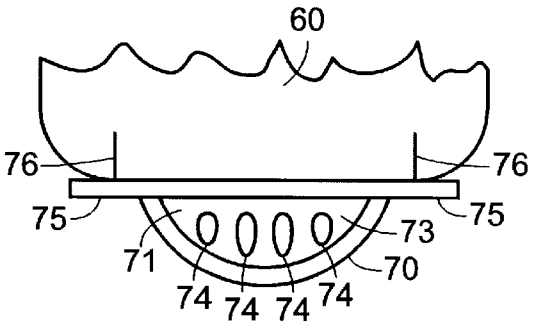
FIG. 8 is a top view of the base.

In a second embodiment of the invention 7 shown in FIG. 3, the rod bottom end 52 extends approximately eighteen inches below the mooring buoy bottom 42. The portion 57 of the rod 50 extending below the mooring buoy bottom 42 acts as a,lever to keep the invention 7 vertically erect. As in the first embodiment 1 of the invention, the rod bottom end 52 terminates in a threaded ⅝ inch galvanized ring 54. A ⅜ inch or greater diameter chain 55 is attached to the ring 54 and anchored to the bottom 6 beneath the water 5.

The line holder 20 is attached to the pole 10 approximately ten inches below the pole top end 11. The line holder 20 has an upper neck portion 21 and a hook-shaped lower portion 22. The line holder 20 is comprised of 5/16 inch diameter, size AWG4 600 volt, black, electrical wire. The wire is comprised of soft annealed stranded copper conductor encased in PVC insulation, which in turn is encased in a nylon jacket. The line holder 20 is strong enough to hold a mooring line 30 but flexible enough to release the line 30 when a pulling pressure is applied to the line 30. Being black, the line holder 20 is UV resistant to sun exposure. The line holder 20 also has excellent abrasion, chemical, gasoline and oil resistance. It has excellent resistance to most chemicals, solvents or fumes. As stated above, the line holder lower portion 22 is bent into the general shape of a hook. The type of wire used in the line holder 20 has a "memory" which retains its bent configuration nearly indefinitely. The line holder 20 is secured to the pole 10 by means of stainless steel wire 25, or equivalent, wrapped about the neck 21 of the line holder 20. An eight inch length of shrinkable polyolefin tubing 26 is positioned over the wire-wrapped line holder neck 21 and pole 10 and shrunk tight by a heat gun. The resiliency of the invention line holder 20 and its ability to return substantially to its original shape provide the unique and novel characteristic of this invention 1.

In these invention embodiments three strips 13 of reflective tape may be attached to the pole 10 at various desired locations along the pole 10. The tape 13 is especially helpful at night in providing a boat operator an excellent reference point to determine the location of the mooring buoy 40. A unique reference marker 14 may be attached to the top 11 of the pole 10. In these embodiments of the invention 1, 7, a colored ball 14 may be attached to the pole top 11 with a stainless steels crew, glue, or other attaching means. The ball 14 may be of various colors and patterns to assist a boat operator in identifying his particular buoy 40.

The mooring (or spring) line 30 is attached at one end 31 to a link 58 in the mooring buoy chain 55 or to the buoy ring 54 beneath the buoy 40. The line's other end 32 is a free end. The remainder of the mooring line 30 may be coiled and hung on the invention line holder 20. Alternatively, the mooring line free end 32 may have a loop 34 formed therein for engaging the line holder 20. The mooring line 30 may also have a buoyant element 33 attached near to the mooring line free end 32. The buoyant element 33 provides a means for grasping the mooring line 30 if the line 30 should fall from the line holder 20.

As the boat 2 approaches the mooring buoy 40, bow 3 first, a deckhand reaches out from the boat side 4 to grasp any part of the mooring line 30 the deckhand can reach. A horizontal pull will release the unattached portion of the coiled mooring line 30 from the line holder 20. The flexible nature of the line holder 20 eliminates entanglements often experienced with prior art devices. The mooring line free end 32 is then secured on the boat deck at a desired length.

In a third embodiment 8 of the invention, the line holder 20 is attached to a piling 60 by means of a base unit 70. See FIGS. 5–8. Each base unit 70 is adapted from a bumper known as a dock guard. The base unit 70 is made from vinyl and has an elongated, vertical, generally half-cylindrical shaped body 79. The base unit 70 has a vertical top 71 and vertical bottom 72 and a longitudinal axis extending from top 71 to bottom 72. The base unit interior 73 has four elongated channels 74 formed therein, each channel 74 opening to and extending from the base unit top 71 to the base unit bottom 72. The base unit 70 has two elongated, flat, vertical sides 75 extending from top 71 to bottom 72. Each base unit 70 is attached to a piling 60 by means of fasteners 76. On wood pilings six fasteners 76 may be used, three to a side 75. A regular galvanized roofing nail with a large head is appropriate or a #10 stainless screw with a finish washer. For concrete or metal piles, two nylon straps will hold the base unit to the piling very well.

The line holder 20 is inserted into a base unit channel 74. The line holder upper neck portion 21 is inserted into a channel 74, through the base unit bottom end 72 up to and through the base unit top 71. The line holder hooked lower portion 22 extends below the base unit 70. The top 23 of the line holder 20 is bent at ninety degrees to the line holder upper neck portion 21 thereby preventing the line holder 20 from slipping down through the base unit 70. The line holder 20 may rotate 180 degrees within a base unit channel 74. If a boat 2 comes in contact with the base unit 70, it will not harm it as the base unit 70 will act like a marine bumper. If any part of the boat 2 becomes entangled with the line holder 20, it will release when the line holder 20 rotates or bends. For night landings, a label of reflective tape 77 is applied to the base unit exterior surface 78.

A cleat 61 may be attached to the piling 60 between the base unit 70 and the piling top 62. See FIG. 6. The mooring line 30 is attached at one end 31 to the cleat 61. The remainder of the mooring line 30 may be coiled and hung on the invention line holder 20. As the boat 2 approaches the pilings 60 a deckhand reaches out from the boat side 4 to grasp any part of the mooring line 30 the deckhand can reach. A horizontal pull will release the unattached portion of the coiled mooring line 30. The flexible nature of the line holder 20 nearly eliminates entanglements often experienced with prior art devices. The mooring line free end 32 is then secured on the boat deck at a desired length. If there is no cleat 61, one line end 31 may be tied about the piling. See FIG. 5.

It is understood that the above-described embodiment is merely illustrative of the application. Other embodiments may be readily devised by those skilled in the art which will embody the principles of the invention and fall within the spirit and scope thereof.

I claim:

1. An apparatus for aiding the mooring of a boat in water, comprising:

a generally round, ball-shaped buoy having a buoyancy which generally adapts it to being half in and half out of the water, said buoy having a top defined as that point vertically highest out of calm water, and having a bottom defined as that point vertically deepest in calm water, said buoy having a vertical central axis defined by the buoy top and bottom, said buoy having a hole formed along its vertical central axis extending from the buoy top to the buoy bottom;

a rod fitted into said hole, said rod having a top end and a bottom end;

a hollow cylindrical collar element fixedly attached to the rod top end;

a ring attached to said rod bottom end;

a mooring chain having two ends, one end attached to said ring and the other end anchored to a bottom beneath said water;

a straight, vertical, flexible, weather-impervious, pole having a top end, a bottom end, and a cylindrical body interconnecting said ends, said pole bottom being attached to said collar element;

a resilient, line holder having a straight, upper neck portion and a hook-shaped lower portion, said upper neck portion being attached to said pole body near to the top end of the pole, said line holder being adapted to hold in its hooked-shaped portion an unattached portion of a mooring line in a coil until removed when mooring a boat, said line holder hooked-shaped portion being adapted to return substantially to its original shape if said line holder's lower portion hook-shape is distorted during mooring, wherein said line holder is comprised of:

a soft annealed stranded copper conductor;

PVC insulation encasing said conductor;

a black nylon jacket encasing said PVC insulation encased conductor;

a wire wrapped about the line holder neck portion and said pole body thereby securing said line holder to said pole; and a length of shrinkable polyolefin tubing positioned over the wire-wrapped line holder neck and pole body, said tubing having been shrunk tight by an external heat source;

a mooring line having a free end and an end attached to said mooring chain;

a plurality of reflective strips attached to said pole;

a unique reference marker attached to the top of the pole; and a buoyant element attached near to the mooring line free end.

2. An apparatus for aiding the mooring of a boat in water, comprising:

a piling;

a base unit attached to said piling, said base unit being made from a resilient material and having an elongated, vertical, generally half-cylindrical shaped body with a vertical top and vertical bottom and a longitudinal axis extending from top to bottom, said base unit having an interior with a plurality of elongated channels formed therein, each said channel opening to and extending from the base unit vertical top to the base unit vertical bottom, said base unit having two elongated, flat, vertical sides extending from top to bottom, said base unit being attached to a piling by means of a plurality of fasteners;

a resilient, line holder having a straight, upper neck portion and a hook-shaped lower portion, said upper neck portion being attached to said base unit, said line holder being adapted to hold in its hooked-shaped portion an unattached portion of a mooring line in a coil until removed when mooring a boat, said line holder hooked-shaped portion being adapted to return substantially to its original shape if said line holder's lower portion hook-shape is distorted during mooring, wherein said line holder is comprised of:

a soft annealed stranded copper conductor;

PVC insulation encasing said conductor;

a black nylon jacket encasing said PVC insulation encased conductor;

wherein said line holder upper neck portion is adapted to being inserted into a said channel, through the base unit vertical bottom up to and through the base unit vertical top, said line holder hooked lower portion extending below the base unit, said line holder top extending above the base unit, said line holder top being bent at an angle to the line holder upper neck portion;

a mooring line having a free end and an end attached to said piling.

3. An apparatus as recited in claim 2, further comprising:

a label of reflective tape applied to the base unit body.

4. An apparatus as recited in claim 3, further comprising:

a cleat attached to the piling.

* * * * *